US012559887B2

(12) United States Patent
Pasari

(10) Patent No.: US 12,559,887 B2
(45) Date of Patent: Feb. 24, 2026

(54) UNBLEACHED NATURAL BROWN COPIER PAPER AND PROCESS THEREOF

(71) Applicant: SHREE KRISHNA PAPER MILLS AND INDUSTRIES LIMITED, Daryaganj (IN)

(72) Inventor: Naynesh Pasari, Daryaganj (IN)

(73) Assignee: SHREE KRISHNA PAPER MILLS AND INDUSTRIES LIMITED, Daryaganj (IN)

( * ) Notice: Subject to any disclaimer, the term of this patent is extended or adjusted under 35 U.S.C. 154(b) by 144 days.

(21) Appl. No.: 18/393,902

(22) Filed: Dec. 22, 2023

(65) Prior Publication Data

US 2024/0240404 A1 Jul. 18, 2024

(51) Int. Cl.

| | |
|---|---|
| ***D21H 17/17*** | (2006.01) |
| ***D21H 11/14*** | (2006.01) |
| ***D21H 17/00*** | (2006.01) |
| ***D21H 19/40*** | (2006.01) |
| ***D21H 19/54*** | (2006.01) |
| ***D21H 21/16*** | (2006.01) |
| ***D21H 23/52*** | (2006.01) |

(52) U.S. Cl.

CPC ..... *D21H 11/14* (2013.01); *D21H 17/005* (2013.01); *D21H 17/17* (2013.01); *D21H 17/72* (2013.01); *D21H 19/40* (2013.01); *D21H 19/54* (2013.01); *D21H 21/16* (2013.01); *D21H 23/52* (2013.01)

(58) Field of Classification Search

CPC ..... D21H 11/14; D21H 21/16; D21H 19/40; D21H 17/17

USPC ..... 162/135

See application file for complete search history.

(56) References Cited

U.S. PATENT DOCUMENTS

| | | | | |
|---|---|---|---|---|
| 2002/0062938 | A1* | 5/2002 | Westman | D21H 23/28 162/173 |
| 2019/0177913 | A1* | 6/2019 | Basilio | D21H 21/02 |
| 2020/0063366 | A1* | 2/2020 | Parker | D04H 1/4258 |

* cited by examiner

*Primary Examiner* — Jacob T Minskey

(74) *Attorney, Agent, or Firm* — Kevin J Fournier Intellectual Property Legal Services Ltd.; Kevin J Fournier

(57) ABSTRACT

The present invention discloses a composition of an unbleached natural brown copier paper without using any bleaching chemicals or dyes comprising of pulp extracted from waste paper material of corrugated cartons, starch, and fillers. It further includes AKD (Alkyl Ketene Dimer) and enzymes. The waste paper material includes the percentage of 30% to 60% old Indian corrugated cartons (OCC), 20% to 70% old imported corrugated cartons (OCC) and 20% to 50% white record/sorted office paper (SOP).

4 Claims, 1 Drawing Sheet

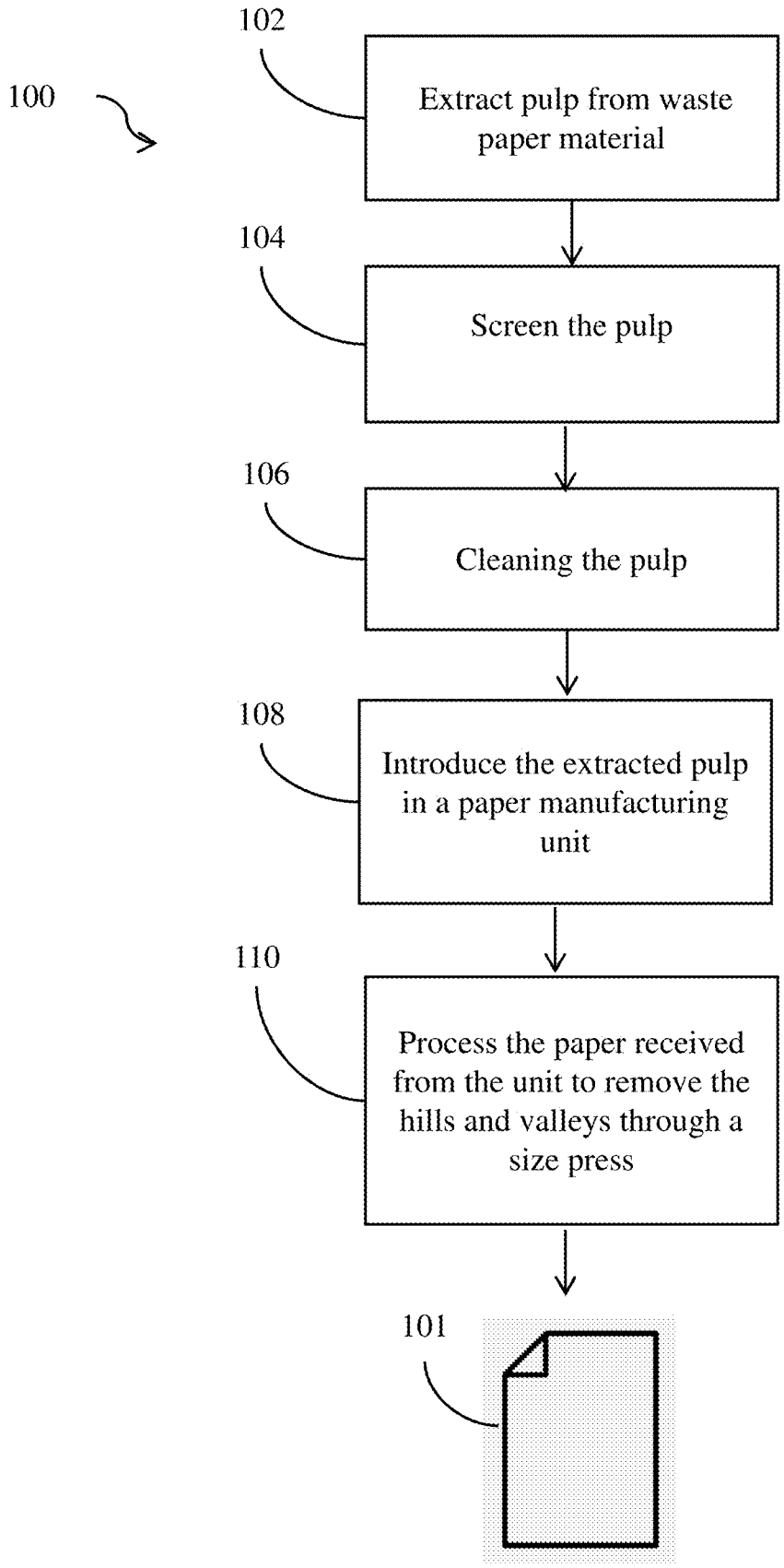
100
102
Extract pulp from waste paper material
104
Screen the pulp
106
Cleaning the pulp
108
Introduce the extracted pulp in a paper manufacturing unit
110
Process the paper received from the unit to remove the hills and valleys through a size press
101

UNBLEACHED NATURAL BROWN COPIER PAPER AND PROCESS THEREOF

CROSS-REFERENCE TO RELATED APPLICATIONS

This application claims priority to Indian Application No. 202311002833, filed Jan. 13, 2023, the entirety of which is incorporated by reference.

TECHNICAL FIELD

The present invention is related to a composition of an unbleached natural brown copier paper and more particularly, a natural brown copier paper comprising of pulp extracted from waste paper material (old corrugated carton and/or sorted office paper), starch, and filler.

BACKGROUND

Pulp and paper industries are globally dominated by Asian, East Latin American, Northern European, North American, and Australian companies. Total paper production is increasing 24.0% over the previous decade. According to current global paper production statistics, China is the largest producer, followed by the United States. India's market share is around 3.7%, and it is steadily increasing at a rate of 7.0% per year (Balda, Sharma, Capalash, & Sharma, 2019; Kaur, Bhardwaj, & Lohchab, 2017). Pulp and paper industries are, without a doubt, a significant and ever-growing part of the global economy. However, it must continue to encounter cost-cutting initiatives and environmental protection agency pressures to reduce and release hazardous chemicals without sacrificing paper quality. Furthermore, as people have become more aware of the importance of maintaining environmental protection standards, market demand for chlorine-free bleached paper has grown significantly in recent years.

Paper industry uses huge amount of freshwater during different steps of the papermaking process. Most paper mills have effluent treatment plants which recover the waste paper into recovered water for reuse or plantation. A lot of investment has taken place over the years on water recovery systems in paper making along with reduction of water usage in paper. Even though a lot of headway has taken place in the technology but the costs associated with the investment make it unviable. At times traces of chemicals remain even with the water discharged which takes place when paper is bleached with several chemicals such as hydrogen peroxide, sodium bisulphite, sodium silicate and various other chemicals used to bleach the paper to make it white and bright.

Today, paper is an integral part of our life, we cannot live without paper due to the need in reading, and writing. The papermaking industry as well as other industries have long sought methods for enhancing the strength of products formed from fibrous materials such as, for example, paper and board products formed of cellulose fiber or pulp as a constituent. The dry-strength and related properties of a sheet formed from fibrous materials are especially important for various purposes. The problems and limitations presented by inadequate dry-strength have been particularly acute in the numerous industries where recycled furnish or fiber mechanically-derived from wood is utilized in whole or in part. In the papermaking industry for example, recycled cellulose fiber is typically used in the manufacture of newsprint and lightweight coated papers. These recycled fibers, however, are of a generally shorter length than chemically-pulped fibers. Paper produced from the shorter length recycled fibers have been found to have relatively poor dry-strength properties in comparison to paper manufactured from virgin, chemically-pulped fiber. Various methods have been suggested in the past for improving the dry-strength and related properties of a sheet formed from fibrous materials such as paper or board materials formed of cellulose fiber.

Paper products and methods are known in the art for improving the dry-strength properties of paper products. One such product is disclosed in ES2686850T3 for paper product comprising high energy TMP (thermomechanical pulp), low energy TMP, microfibrillated cellulose and, optionally, an inorganic particulate material, in which the paper product comprises at least 30% by weight of high energy TMP and low energy TMP, relative to the total weight of the paper product, in which the weight ratio of high energy TMP to low energy TMP is 99:1 to 1:99 and in which the low energy TMP has a drainage rate according to the Canadian standard of approximately 80 to approximately 130 $cm^3$, and in which the high energy TMP has a drainage rate according to the Canadian standard of approximately to approximately 60 $cm^3$.

JP6966493B2 discloses an aqueous suspension or papermaking composition comprising microfibrillated cellulose that can provide a paper product with improved paper rupture strength reinforcing attributes, is adjusted to become the aqueous suspension comprising microfibrillated cellulose, by being subjected to high shear generated at least partially by a dynamic shear element to improve the paper burst strength reinforcing attribute of the microfibrillated cellulose. The "high shear" means share having a shear rate of at least 10,000 s-1.

ES2857512T3 discloses a paper or board product comprising: (i) a cellulose-containing substrate; and (ii) a top layer comprising an inorganic particulate material and 5% to 30% by weight microfibrillated cellulose based on the total weight of the top layer, wherein the content of inorganic particulate material is 67 wt % to 92 wt % based on the total weight of the top layer, where the microfibrillated cellulose has a dso ranging from 5 μm to 500 μm, as measured by laser light scattering and where the inorganic particulate material has a particle size distribution where at least 20% to at least 95% by weight of the particles have an esd of less than 2 μm, and further where the measured gloss (according to ISO 11475 (F8; D65-400 nm)) in the upper layer is at least 65%; and wherein the top layer has a grammage of 15 $g/m^2$ to 40 $g/m^2$.

Oxygen delignification plants are becoming increasingly popular as a pulp pretreatment option, but they have several drawbacks, including high installation costs, elevated temperature (80° C.-120° C.), highly alkaline conditions (pH>10), and high pressure (600-800 kPa) for achieving a rational reaction efficiency. The recovery cycle is also increased, raising the time and energy required for paper production. Hydrogen peroxide is a costly substitute for industrial use. Ozone treatment has decent effects, but it degrades the fibers, resulting in final paper products losing strength. Depending on the raw material, industries use a variety of pulps, including softwood, hardwood, and agricultural waste such as cereal straw, wheat straw, and sugarcane bagasse. Wood-based virgin pulp dominates the paper industry, and it is expected to account for half of all industrial wood harvest by 2050. However, due to the rising demand for paper and declining forest cover areas around the world, the use of agropulp in the paper industry is increasing. Currently all Copier paper is white, bleached and manufactured using either tree pulp, agriculture pulp or waste paper pulp which uses high amount of water, chemicals, dyes.

To overcome the aforesaid problems, the present invention discloses an unbleached Natural Brown Copier Paper composed of pulp fibre extracted from waste paper material, starch, and filler wherein waste paper material comprises old Indian corrugated cartons (OCC), old imported corrugated cartons (OCC) and white record/sorted office paper (SOP).

The paper of the present invention is made of waste paper materials, and without the process of bleaching and thus, saving the huge amount of water and chemicals involved in the process of making the unbleached natural brown copier paper. Therefore, the present invention also provides a method of preparing the natural brown copier paper as provided in an embodiment of the present invention.

SUMMARY

The prime objective of the present invention is to provide a composition of an unbleached natural brown copier paper without the process of bleaching.

Another objective of the present invention is to provide a composition of an unbleached natural brown copier paper comprising of pulp extracted waste paper material (old corrugated carton and/or sorted office paper), starch, and filler.

Another objective of the present invention is to provide a composition of an unbleached natural brown copier paper comprising of pulp extracted waste paper material (old corrugated carton and/or sorted office paper), starch, filler and AKD (Alkyl Ketene Dimer).

Another objective of the present invention is to provide a composition of a natural brown copier paper using old corrugated boxes as a primary raw material for fibre wherein raw material of waste corrugated boxes comprises old Indian corrugated cartons (OCC), old imported corrugated cartons (OCC) and white record/sorted office paper (SOP) without any bleaching chemicals to save water and save the water from being discharged which may be toxic.

Another objective of the present invention is to provide a method of preparing the unbleached natural brown copier according to the present invention which uses less water during and zero bleaching chemicals in the manufacturing process with the waste materials as raw materials.

These and other objectives of the present invention will be apparent from the drawings and descriptions herein. Every objective of the invention is attained by at least one embodiment of the present invention.

BRIEF DESCRIPTION OF THE DRAWINGS

FIG. 1 is a flowchart describing a process according to an embodiment.

DETAILED DESCRIPTION

The embodiments herein and the various features and advantageous details thereof are explained more comprehensively with reference to the non-limiting embodiments that are detailed in the following description. Descriptions of well-known components and processing techniques are omitted so as to not unnecessarily obscure the embodiments herein.

The following description includes the preferred best mode of one embodiment of the present invention. It will be clear from this description of the invention that the invention is not limited to these illustrated embodiments but that the invention also includes a variety of modifications and embodiments thereto. Therefore, the present description should be seen as illustrative and not limiting.

Unless otherwise specified, all terms used in disclosing the invention, including technical and specific terms, have the meaning as commonly understood by one of ordinary skill in the art to which this invention belongs. By means of further guidance, term definition may be included to better appreciate the teaching of the present invention.

As used in the description herein, the meaning of "a", "an", and "the" includes plural reference unless the context clearly dictates otherwise. Also, as used in the description herein, the meaning of "in" includes "in" and "on" unless the context clearly dictates otherwise.

As used herein, "plurality" means two or more.

As used herein, the terms "comprising," "including," "carrying," "having," "containing," "involving," and the like are to be understood to be open-ended, i.e., to mean including but not limited to.

The present invention, according to one embodiment, discloses a composition of an unbleached natural brown copier paper without any bleaching chemicals comprising of pulp extracted from waste paper material (old corrugated carton), starch, and filler. It further includes AKD (Alkyl Ketene Dimer) and enzymes.

The waste paper material of corrugated cartons comprises various types of used cartons in predefined ratio. The waste paper material comprises various types of used cartons with variations based on raw material quality.

The paper of the present invention is to be used for printing, publishing, scanning, photocopying and others.

In one example, the waste paper material includes the percentage of 30% to 60% old Indian corrugated cartons (OCC), 20% to 70% old imported corrugated cartons (OCC) and 20% to 50% white record/sorted office paper (SOP).

Preferably, the waste paper material used is 60% old Indian corrugated cartons (OCC), 20% old imported corrugated cartons (OCC) and 20% white record/sorted office paper (SOP).

Preferably, the waste paper material used is 50% old Indian corrugated cartons (OCC), 25% old imported corrugated cartons (OCC) and 25% white record/sorted office paper (SOP).

Preferably, the waste paper material used is 40% old Indian corrugated cartons (OCC), 30% old imported corrugated cartons (OCC) and 30% white record/sorted office paper (SOP).

However, the ratio of using old Indian corrugated cartons (OCC), old imported corrugated cartons (OCC) and white record/sorted office paper (SOP) are not limited to these and preferred ranges are given for the best mode of the exemplary embodiment of the present invention.

In an example, the cartons are OCC which are selected from double sorted OCC, OCC premium, 5 ply cartons, KCB (Kraft liner board), NDLKC, New corrugated cutting etc. but are not limited to these. Similarly, the SOP or sorted office paper are selected from white records, office records, Coated book stock, white shavings and any type of white recycled fibre that can be used in paper making and are not limited to these.

Thus, as mentioned above the paper of the present invention is made of waste paper materials, and without the process of bleaching and thus, saving the huge amount of water involved in the process of making the unbleached natural brown copier paper. Upto 10,000 litres of water per 1000 kg of paper is saving during the unbleaching paper manufacturing process.

Another embodiment discloses a method of preparing the unbleached natural brown copier paper according to the present invention which uses less water during the manufacturing process with the waste materials as raw materials.

Method of Preparing the Unbleached Natural Brown Copier Paper

The present method prepares the unbleached natural brown copier paper with the composition of the paper of the present invention which includes pulp extracted from waste material comprises old corrugated cartons, soap stone/calcium carbonate/ground carbonate similar filler, starch and AKD.

Composition includes pulp extracted waste paper material (old corrugated carton), starch, and fillers. The process of preparing the paper involves mixing the pulp extracted from waste paper material with the starch, soapstone or similar filler materials such as calcium carbonate, etc in the paper manufacturing unit. This unit includes pulp mill, stock preparation and paper machine to achieve the paper of the present invention using the composition as disclosed.

FIG. 1 is a flowchart describing a process 100 to produce unbleached natural brown copier paper 101. The pulp is extracted from the waste raw material (block 102) and is introduced in the paper manufacturing unit at the stock preparation area (block 108). The product is further processed to remove the hills and valleys by sizing which is done through a size press or a film press on the paper machine (block 110). This has a starch coating on size press in a range of 20 kg to 40 kg per ton of paper or 0.02% to 0.04% per kg on paper along with enzyme coating in a solution of water. This starch gives strength to the paper and also removes hills and valleys. Further, Poly Aluminium Chloride (PAC) is added to maintain the pH of paper in a range of 2 kg to 8 kg per ton of paper or 0.002% to 0.008% per kg of paper. Further the enzyme addition in the solution or a chemical called surface size agent helps to maintain COBB in the paper making it printer-friendly which is added in the range of 2 kg to 8 kg per ton of paper. Also, soap stone powder or ground calcium carbon or any other filler (non fibre) is added in a range of 300 kg to 500 kg per ton of paper or 0.3% to 0.5% per kg on paper.

In another embodiment, the pulp is extracted from waste raw material is introduced in the paper manufacturing unit with the AKD chemicals, preferably in the range of 8 kg to 30 kg per ton of paper or 0.008% to 0.03% of AKD per kg on paper (not limited to these) at the stock preparation area. The product is further processed to remove the hills and valleys by sizing which is done through a size press or a film press on the paper machine. This has a starch coating on size press in a range of 20 kg to 40 kg per ton of paper or 0.02% to 0.04% per kg on paper along with enzyme coating in a solution of water. This starch gives strength to the paper and also removes hills and valleys. Further, Poly Aluminium Chloride (PAC) is added to maintain the pH of paper in a range of 2 kg to 8 kg per ton of paper or 0.002% to 0.008% per kg of paper. Further the enzyme addition in the solution or a chemical called surface size agent helps to maintain COBB in the paper making it printer-friendly which is added in the range of 2 kg to 8 kg per ton of paper. Also, soap stone powder or ground calcium carbon or any other filler (non fibre) is added in a range of 300 kg to 500 kg per ton of paper or 0.3% to 0.5% per kg on paper.

In a preferred example, the pulp extracted from the waste paper material is introduced in the paper manufacturing unit. The pulp is processed on a paper machine through size press and a film press to remove the hills and valleys in the paper. In the size press the paper is processed through a mixture of starch coating 30 kg per ton of paper or 0.3% per kg along with surface size agent and poly aluminium chloride and soap stone powder. The coating slurry is mixture of starch, surface size agent, poly aluminium chloride in the following ratio starch minimum 30 kg per ton of paper, surface size agent minimum 3 kg per ton of paper and poly aluminium chloride minimum 2 kg per ton of paper.

The other chemicals and enzymes are selected from native starch, oxidised starch powder, cationic dry strength resin and non-ionic guar gum. The fillers are selected from one or more of soap stone, calcium carbonate, clay silica, talc, and kaolin.

The paper machine also has a kuster calender/soft nip/soft calendar that applies pressure on the paper to ensure the sheet made is smooth, free from hills and valleys and compressed to provide a smooth paper. The calendar system could range from any brand or make depending on the machine.

The present subject matter further discloses, in detail, the manufacturing unit as follows which involves one or more of the components:

Conveyor

The conveyor is being used to feed raw materials into pulper. It is being operated by electric and following all safety norms. It avoids manual feeding and reduces manpower. With a load cell provision, the exact quantity is being added into pulper. It has a large loading capacity. It is mainly used for conveying various kinds of bulk or bundled materials and to be feed into pulper. With robust structure, adopt chain plate transmission, drive and conveying material trough plate movement, has the large conveying capacity, low power consumption, less wear and tear, reliable work. Strive to even feed material when it is in operation, feeding maximum weight should be controlled in the specified scope, stop or start when Stop or start is not suitable, in the operation it should be frequently checked and adjusted.

High Consistency Pulper—

High consistency pulper is being used for batch process at a controlled raw material, chemicals and water addition for a certain fix time circulation to get better and uniform quality. It is designed with a principle of the hydraulic whirlpool. Rotors are designed in such a way to get better hydration and to accelerate defibering. The specially designed impeller of the rotor are oblique spirochete, the shear effect is weak, only divestitures the impurity in the raw material, and it will not form of small flakes, so it creates favorable conditions for pulp screening. It runs between 13%-16% high consistency pulp, effective chemical mixture and friction between fibers under high consistency make the sticky particle separate from the surface of fiber fully.

In another embodiment, different types of pulper such as hydra pulper or continuous pulper can be used based on the manufacturing unit of the paper.

Poire or Hydra Purge

This equipment is largely used for continuous removal of large contaminants which assured no loss of fibers and arrested pulper downtime. This also increases better efficiency as well as production and stock cleanliness. It is also known as Hydra-purge.

Operating Principle—In the exemplary form of Poire or Hydra Purge is an auxiliary tub with rotor operating inside the screening area is open to be the lower part of the main pulper during the greater part of the operation cycle. Mix stock flows from the beginning of the cycle towards the rotor of the tub. After disintegration, it returns to the pulper and the contaminants are accumulated into the tub and the main pulper will be isolated after the Poire tub is filled with contaminants as per isolation target measurement. And then backwater is being used to wash up the tub. After washing the water supply stopped and contaminants are discharged with the on-off valve without losing any good fiber. The connection, again, is re-established with the same process and follow from the beginning without any human interventions and special supervisions.

Dump Tower—

Higher capacity tower kept to enhanced stock capacity increase. To provide good retention time to fibers which improve better stock quality as well as it will help further in cleaning, washing, and disintegration. In the bottom portion, it's having dilution provision to get the better stock flow and well as uniform consistency control.

High-Density Cleaner Chest:

This is a simple close chest with 50 Mt cub in capacity with a maintained consistency range of 3.0-3.5%. This consistency is being maintained to feed into High Density (HD) cleaner with constant control of inlet pressure and head. This chest design is made in such a way that during washing and cleaning 100% stock is being consumed.

High-Density Cleaner

High density (or HD) cleaners are large diameter forward cleaners capable of processing huge quantity of raw materials. The main purpose of high-density cleaners is to separate heavy contaminants from fibers in suspensions of fibers in water. This protects downstream equipment from excessive wear and damage. This equipment operates as high-density cleaners in secondary fiber, pulp mill, stock preparation, and broke systems. Parts that have a higher density than the pulp, such as screws, nails, staples, steel parts, stones, and pebbles are effectively removed and gathered in the reject chamber.

Working principle—High-Density Cleaner takes care of unwanted particles and removes them from the suspension using the vortex separation principle. The tangential inlet accelerates the stock to downward centrifugal motion. Impurities with high specific gravity are forced to the outer wall of the cone and downward to collect in a trap. From hole, they are isolated and removed through a valve connected chamber with intermittent discharge. This way clean stock raises through the middle of center vortex towards the outlet. Motor injection at the base of the cone maintains the vortex action and aids fiber recovery. The cleaner comes with a separate rotor, which allows it to operate without any pressure drop.

Screening

In the process 100, the pulp is screened (block 104). Screening is a key process in pulp and paper production and is used to enhance the quality of pulp destined for a wide range of pulp and paper products. For such any type of equipment that has screen can be used like coarse screen or Turbo.

While the usual goal of screening is to remove oversize contaminants from the pulp, it is finding increasing use for fiber fractionation as well. Product quality can be improved by fractionating fibers for targeted processing or for use in specialty paper products. For any paper mill screen, selection is a significant matter. All type of screen is not suitable for all kinds of fiber. To select a screen it should be considered the kind of fiber, filler, cost and repair, power consumption, efficiency, capacity, space required, etc.

Various factor effect on screening performance. Various factor that effects on screening performance such as stock consistency, type of fiber, type and size of holes, type of plate cleaning mechanism, level of coarse fiber and foreign matter, rejection rate, flow configuration, flow rate, stock temperature, stock pressure etc. Water (consistency) has an important function in screening section, water acts as a conveyer for the fiber. The consistency of the pulp of the storage tanks may be 3 to 4 percent. When the pulp leaving the storage tank, the consistency should be reduced by adding white water. The nature of pulp, the inlet consistency of the screening equipment should be 1.5% to 2.0% for optimum result. When the consistency comes over 2.0%, then the rejections will increase. The proper consistency of the stock ought to be 1.0% to 2.0% depending, on the type of pulp screening.

The diameter of the pulp screening equipment holes is another important variable for screening performance. In case of the coarse screen, it should not be more than 3/16 ins in diameter; but it is better to keep 1/8 ins in diameter. Whereas it ought to be 0.045 to 0.0625 ins in case of fine screen. It decides the minimum size of particle that will be rejected.

After fine screening the rejected stock may around 10-13%; it rejects such fibers that are not too coarse. Hence it may advise to rescreen the stock with the proper dilution to better recover. It may be a coarse screen. The accepted stock of fine screening is excellent quality for supply to the next stage.

The coarse screening removes the heavier particles such as very coarse fibers, knots, shives, dirt, and sand and it may be 4 to 5 percent of the whole stock. It may differ basis on kinds of fiber and type of screening and the diameter of the hole. The accepted stock of coarse screening is sent to the fine screening inlet side to rescreen for greater efficiency in the screening section.

Centri-Cleaners

Fibers and liquid containing particles enter the feed inlet tangentially to set up a circular flow. Inner tangential slots located in the cylindrical top helps to create a vortex and accelerate the flow into the inner barrel wall. Due to the centrifugal action, heavier particles are forced to the sides of the barrel wall, pushed downwards and they eventually accumulate in the collection chamber. Vent-tube draws fluid and pressure to allow finer solids to settle down and creates a stabilized vortex flow. A Deflector plate, located on the top of the collection chamber halts the vortex thus changing the direction of flow. Clear liquid moves upwards through the vortex and exit via the separator's top outlet. Cleaner along the tangent direction, using the pressure differences between the inlet and outlet to make the pulp do the spiral motion along the cone and generate centrifugal force. Used to remove air, dirt, shives, and specks from pulp/fiber stock. Pulp stock at 0.5 to 1.0% consistency enters the tangential inlet into Barrel and accelerates the stock to downward centrifugal motion. The process 100 continues with pulp cleaning (block 106). Contaminants like dirt, shive, and speck with high specific gravity are forced to the outer wall of cone and downward through reject outlet orifice. The cleaned pulp stock rises through the center of the bottle toward the accept outlet. For optimization of Centri-cleaners performances, we are critically following Pressure drop right, inlet consistency right, all bottles are in right conditions as per standards, inlet pressure consistent and uniform.

Pulp Thickeners

One of the type of pulp thickners is a polydisc filter which is a combination of a number of plastic discs stacked on top of each other like a pile of poker chips. All discs are covered with small grooves. The discs (or rings) each have a hole in the middle, forming a hollow cylinder in the middle of the stack. The water passes through the small passages in between and the impurities are trapped behind. The filtration quality is based on the quantity and size of particles that the filtering element is able to retain. Higher quality filtration simply means cleaner water. This depends on the geometry of the channels, including the size, length, angle, and a number of generated intersection points. The discs are typically denoting the level of filtration. The typical range is from 25 microns for the finest level of filtration to 400 microns for the coarsest. Sometimes the filtration quality is given as the equivalent mesh size of a comparable screen filter.

Disc Filter is being cleaned with backflushed in such a way that the discs are able to separate and spin during the cleaning cycle. A booster pump is required for backflushing. Disc filters can be used for many types of contaminants, including fine sand and organic matter.

The mechanism for Poly Disc Filter operation: The face on each side of the disc has uniform sized grooves set at an angle to the rays of the circle. The cross-section of each groove forms an equilateral triangle. This cross section remains constant throughout the length of the groove. The diameter of the largest circle inscribed inside this triangular cross-section is the filtration size rating. When multiple discs are stacked and centered around a skeletal cylindrical structure called a spine, the discs form a hollow cylinder with the ends of the grooves exposed to both the inside and outside surfaces. When looking down on a single disc lying flat on a horizontal surface, the grooves on the top surface of the disc angle out and to the right of a ray to the circle. The hidden grooves, on the underside of this same disc, angle out and to the left of the circle's rays. This pattern forms numerous intersections of groove troughs and ridges along the length of each groove. The groove cross-section formed by any two adjacent discs will vary along the length of the groove. The change in cross-section causes turbulence in the flow. The flow stream and suspended particles move along the length of each groove following the sequence. A perfectly spherical particle smaller than the separation rating of the discs will pass through the filter without entrapment. However, most suspended particles are irregular in shape. The disc filter causes the flow stream cross-sectional pattern to oscillate while traveling along the length of the grooves. This mechanistic process is very effective in separating rigid suspended particles from a liquid stream.

Unlike two-dimensional separation devices that must possess openings that are physically smaller than the organic particles being targeted, disk filtration devices depend upon the process of particle/surface adhesion. Each particle that is trapped by a screen blocks nearly all of the flow through the trapping opening. Since the organic particles adhering to the groove surfaces of a disc filter can be relatively small compared to the groove cross-section itself, flow continues to go around the trapped particle carrying additional particles to adhere to other areas of the same groove.

This multiple entrapments of organic particles per groove gives this process the ability to continue three to five times longer between backflushes to build up the same differential pressure, given the same flow rate, than a two-dimensional screen. During the filtration process, incoming fluid surrounds the cylindrical stack of compressed discs and passes through the groove passages to the interior of the cylinder. Particles are removed from the stream as described above. Once inside the cylinder, the filtered fluid passes from multiple parallel stacked disc cylinders into a common manifold and out of the filter unit.

Stock Storage Chest

This chest is stock storage chest to enhance the capacity of the plant as well as the continuous running of back end equipment. This chest is specially designed to make chest and it includes a reduced bottom tower with a larger diameter upper zone for storing pulp with a consistency of 8-10% dry pulp. The lower dilution zone is designed to have continuous uniform mixing with water and to feed into the HD cleaner with a constant pressure head.

Screw Conveyor

Screw conveyors are mostly used to move liquid or particulate materials usually within a tube. Especially, a screw conveyor is a mechanism which uses a rolled out helical screw blade also called as flights. Infrequently, a screw conveyor is also called helical conveyor or auger conveyor. They are made in this way so that they help in the easy flow of the material it in horizontal as well as vertical direction. But the inclined conveyors are more useful and transports the material more effectively. Screw conveyors have a number of inlets and material discharging points through which bulk materials can be conveyed and distributed to a number of locations as and when required. For controlling the in and out of the flow, valves can be added to the conveyor.

The transportation of semi-solid materials in a screw conveyor occurs when the helix screw-in the trough casing turns. The trough casing of the conveyor can be of round shape, U-shape or also of rectangular shape.

Also, the particles of the material should be smaller than the screw pitch and the conveyor can have a constant, tapered or variable pitch. Generally, screws with flat-cross sections are more suitable for high-velocity applications.

Materials which have flowability are transported through the screw conveyors and normally sticky and stingy material are avoided to be conveyed through screw conveyors. Also, due to the high friction of the materials against the screw and trough leads to higher power consumption, there are some chances of material degradation. Therefore, screw conveyors have some limitations in the capacity and distance of conveying of the material. Despite this disability of the screw conveyor, they are rather widely used in large as well as small engineering works. A screw conveyor or auger conveyor is a mechanism that uses a rotating helical screw blade, called a "flighting", usually within a tube, to move liquid or granular materials.

They usually consist of a trough or tube containing either a spiral blade coiled around a shaft, driven at one end and held at the other or a "shaftless spiral", driven at one end and free at the other. The rate of volume transfer is proportional to the rotation rate of the shaft. In industrial control applications, the device is often used as a variable rate feeder by varying the rotation rate of the shaft to deliver a measured rate or quantity of material into a process.

Screw conveyors can be operated with the flow of material inclined upward. When space allows, this is a very economical method of elevating and conveying. As the angle of inclination increases, the capacity of a given unit rapidly decreases. The rotating part of the conveyor is sometimes called an auger.

Screw Press

The Screw Press consists of a cylindrical wedge wire basket. A preceding flocculation reactor ensures a fiber flock quality that allows dewatering of the fiber flocks and stabilizes the flocculated fibers.

The free water drains through the basket whilst the solids inside the basket are conveyed gently upwards through the inclined basket by a slowly rotating screw. Continuous dewatering of the sludge takes place in the Screw Press with an increasing build-up of pressure due to the conical basket, which reduces the fiber cake volume in the press zone. The filtration pressure inside the machine is adjustable by means of a pressure cone in the fiber discharge. Screw press separates waste water from suspended solids, saving the cost of disposal. Using a screw and moving rings, it is able to clean itself and remain clog-free. Having a low screw speed; the screw uses very little power and water, outperforming other technologies. It utilizes a central screw auger and a slowly oscillating multi-disk filter to gradually increase pressure on flocculated pulp to produce an exceptionally dry pulp cake.

Kneader or Disperser

The Kneading operation is performed at a consistency above 30.0%. The fiber to fiber rubbing action facilitates the detachment of ink particles from the fibers and reduces their size. This operation does not separate the dirt/ink particles from the stock. The slow, methodical churning of the Kneader (compared to the Disperser) also has a tendency to induce curl to the fibers. This, in turn, decreases the overall strength but increases the softness, or bulk, of the fibers. The main objective for including a dispersion unit in a recycling system is to reduce the size of the remaining contaminant particles in the stock. The Kneader was effective in size reducing the remaining contaminants at all power levels.

Pulp at high consistency is mixed between moving bars on as low-rotating shaft and stationary bars attached to the housing. Strong shear forces (mainly fiber-fiber rubbing) break the contaminants.

Typical Conditions: Consistency=30% K, Temperature=40-50 C, Retention Time=10-60 seconds, RPM=60-900 is available, Gap between bars=10-40 mm, and 3.0-4.5 hp-days/ton.

Blending/Mixing Chest

The stock passes to a blending chest where numerous chemicals can be added to obtain the required characteristics to the finished paper. Example dyes, fillers, pigments, and some chemicals are being added, as per requirements or necessary, to color the paper and paper properties and meet the customer demand. Dyes fix themselves to the cellulose fibers and are fast to light and water. Each grade of papers requires a very accurate blend of pulps and additives.

Paper Machine

After Beating/refining the pulp from stock preparation enters to the paper machine area and it passes through to centricleaner, fan pump, pressure screens and enters to the manifold and then to headbox. The function of the headbox is to receive cleaned pulp stock at the consistency of 0.2-0.8% and distribute it uniformly across the width of wire with a constant head. Rectifier/Evener/Holly rolls are used to provide necessary agitation and even out the distribution of fibers. Headbox is generally of two types, open head box, and pressurized headbox.

Fourdrinier Machine

Fourdrinier machine is consists of wet end by a headbox, wire part, dandy/former which delivers stock to a moving wire part supported by foils/table rolls, suction boxes, couch rolls, return rolls, wire rolls.

Wire Part

The wire part consists of endless wire to support the weak web and drain out water. When stock enters on the wire the consistency of stock remains 0.3-0.9 percent, i.e., 99.7 gm water and 0.3 gm pulp in 100 gm of pulp stock. Such a huge amount of water is being removed on the wire part, press section and dryer section with a gentle and gradual drainage process. About 97% of water is removed on the wire part, 1.5-1.8% on the press section and about 1.0% by the dryer part. Out of 97% water removal on wire part, 83-85% is drained in forming zone mainly due to table rolls/foils, 10-12% is removed by wet & dry suction boxes and 2-3% by Suction Couch roll. Dandy roll and shake are used to improve the sheet formation. Shake helps in improving physical properties, drainage of free stock (less refining stock) is retarded by shake, particularly in forming zone which improves formation. Dandy roll is also used for watermarking and improve formations, it also smoothens the top surface of the paper. It also makes a sheet more dense and compact.

Table Rolls/Foils

Table rolls/foils serve two purposes; firstly to support wire and to create a vacuum at the outgoing nip, this tends to pull water from the web. Water is also removed by surface tension. Water is removed by gravity flow and micro vacuum.

Suction Boxes: Water which cannot be removed by Table rolls is removed by mild vacuum through a series of Suction boxes (6-10 nos.) with lower vacuum zone, dual vacuum and tri vacuum zone. These boxes are connected with a common vacuum pump. The suction boxes remove a good part of the remaining water, at the same time, compact the sheet.

Suction Couch Roll: About 2-3% water is removed by the suction couch, where high vacuum is applied (12-15" Hg). When web leaves the couch roll, it carries about 18-20% dryness Press Part The next step is to remove moisture from the web by mechanical means, i.e., by process of pressing the web, without affecting the quality of the paper/board. Three types of presses are normally used: Plain Press, Suction Press and Reverse Press In plain press, water is removed by mechanical pressing and suction vacuum. Other modern presses are grooved press, uni-press, tri-nip press, etc. The felts are used for the carrier of water between stone and rubber rolls. As the paper web leaves the press section, it carries about 35-40% solids.

Dryer Part

As we have seen that when the web leaves the Press section, it contains 35-40 percent solids. The remaining water from the web is removed by thermal method, which is very expensive. In the conventional method of drying, the sheet is passed around the cylinders and held in intimate contact with the heated surface by means of dryer felts. The number of cylinders and their arrangement in various sections is determined by the following factors.

(a) The basis weight of the sheet
(b) Weight of the water to be evaporated
(c) Speed of the machine
(d) The pressure of steam in various sections.

The dryer section is divided in 4-5 groups, depending on the size of the machine. This is adopted due to the followings, (a) In order to allow a degree of shrinkage control.
(b) To reduce the possibility of sheet creasing and breaking.

Calendaring

After the sheet is dried, it is passed through a stack of heavy metal rolls, where it is calendered under high pressure. The purpose of calendaring is to smooth down the felt and wire marks, to remove cockle and to level off lumpy formation and to make a sheet of uniform caliper throughout the deckle.

Reeling and Rewinding

The final paper having a moisture of 4.0-6.0 percent is reeled on pope realer. The empty shell on which paper reeled rests on the drum and driven round by virtue of the surface friction between them. The full roll of paper is made. Then this roll is sent to the rewinder section or finishing house to slit into customer demand size cutting. After cutting through rewinder that paper reel is being packed for the customer. Occasional customers demanded sheets/ream then reels are sent to duplex or simplex cutter to cut the required sheet.

The paper of the present invention is tested in Pulp and Paper research Institute, Odisha on 31 Jan. 2023 with a sample paper of A4 size and GSM 75. The test results are under table 1 and 2 as follows:

TABLE 1

| S. No. | Clause No./table No./ SI. No. | Parameter-Method of test | Test Description | Min. Limit | Max Limit | Unit | Result/ Observation |
|---|---|---|---|---|---|---|---|
| 1. | 5.5 table 1 vi | Ash content (at 900° C.) 11 of IS 1060 (Part 1) | percent | — | 16.0 | — | 15.5 |
| 2. | 5.2 | Moisture (IS 1060) (Part 5/Sec 2) | Moisture content shall not be more than 6 percent | — | 6.0 | — | 3.0 |

TABLE 2

| S. No. | Clause No./ table No./ SI. No. | Parameter-Method of test | Test Description | Min. Limit | Max Limit | Unit | Result/ Observation |
|---|---|---|---|---|---|---|---|
| 1. | 5.5 table 1 ix b | Tensile index. Cross direction (CD) IS 1060 (part 5/Sec 6) | N · m/g | 25.0 | — | — | 25.9 |
| 2. | 5.5 table 1 ix a | Tensile index. Machine direction (MD) IS 1060 (Part 5/Sec 6) | N · m/g | 40.0 | — | — | 45.0 |
| 3. | 5.5 table 1 viii a | Tear index. Cross direction (CD) IS 1060 (Part 6/Sec 1) | mN · m2/g | 4.5 | — | — | 5.3 |
| 4. | 5.5 table 1 viii a | Tear index Machine direction (MD) IS 1060 (Part 6/Sec 1) | mN · m2/g | 3.5 | — | — | 4.7 |
| 5. | 5.5 table 1 vii b | Taber stiffness. Cross direction (CD) Appendix D of IS 4658 | As in 5.5 Table 1 vii b | 1.0 | — | — | 1.2 |
| 6. | 5.5 table 1 vii a 1 1vii a | Taber stiffness. Machine direction (MD) Appendix D of IS 4658 | As in 5.5 Table vii a | 2.0 | — | — | 2.1 |
| 7. | 5.5 table 1 V | Smoothness for both sides (Bendsten) 3 of IS 9894 | ml/min | I | 300.0 | — | 274.0 |
| 8. | 5.5 table 1 iv | Surface strength, Dennison (Wax pick)8 of IS 1060 (Part 3) | No pick on 12 A | — | — | — | 12A |
| 9. | 5.5 table 1 iii | One minute cobb test, both sides IS 1060 (Part 5/Sec 4) | g/m2 | — | 30.0 | — | 19.6 |
| 10. | 5.5 table 1 ii | Opacity IS/ISO 2471 | percent | 88.0 | — | — | 99.57 |
| 11. | 5.5 table 1 i | ISO brightness IS/ISO2470 (Part 1) | percent | 85.0 | — | — | — |

TABLE 2-continued

| S. No. | Clause No./ table No./ SI. No. | Parameter-Method of test | Test Description | Min. Limit | Max Limit | Unit | Result/ Observation |
|---|---|---|---|---|---|---|---|
| 12. | 5.4 | Thickness IS 1060 (Part 5/Sec 3) | μm | 95.0 | — | — | 109.3 |
| 13. | 5.3 | Grammage IS 1060 (Part 5/Sec 5) & IS 1060 (Part 4/Sec 1) | 70 g/m2 or 75 h/m2354 or 80 g/m2 or 90 g/m2 | 73.12 | 76.88 | — | 76.4 |
| 14. | 5.1 | General | The plain copier paper shall be devoid of pinholes when seen through the naked eyes. The surface shall be well calendered, quite smoothens free from fluff or loose fibers. Surface sizing is desirable for avoiding fluff. | — | — | — | The plain copier paper was devoid of pinholes. The surface was well surface sized, calendered, quite smooth and free from fluff or loose fibre observed. |

The min-max limit shows the currently available bleached white copier parameters. The results obtained column shows the parameters of the unbleached natural brown copier. Therefore, the paper of the present invention fulfils all parameters required for printing functionality and has the advantages wherein the composition of the present paper cuts the cost of preparing the paper with the use of less water and without bleaching the product.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments may be chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

The invention claimed is:

1. A composition of an unbleached natural brown copier paper comprising:

pulp extracted from a wastepaper material;

starch;

fillers;

AKD (Alkyl Ketene Dimer); and

Poly aluminium chloride (PAC), wherein the waste paper material comprises 30% to 60% old corrugated cartons (OCC) sourced from India, 20% to 70% OCC sourced from outside of India, and 20% to 50% white record/sorted office paper (SOP), and wherein the AKD is added in the range of 8 to 30 kg per ton of the paper.

2. The composition of an unbleached natural brown copier paper as claimed in claim 1, wherein the fillers are selected from soapstone, calcium carbonate, clay silica, talc, and kaolin.

3. The composition of an unbleached natural brown copier paper as claimed in claim 1, wherein a coating of the starch is used on size press in a range of 20 to 40 kg per ton of the paper.

4. The composition of an unbleached natural brown copier paper as claimed in claim 1, wherein the fillers are added in the range of 300 to 500 kg per ton of the paper.

* * * * *